US005953831A

United States Patent [19]

Yu

[11] Patent Number: 5,953,831

[45] Date of Patent: Sep. 21, 1999

[54] INFRARED-RADIATING CLOTHES DRYER

[75] Inventor: Shinan Yu, Beijing, China

[73] Assignee: Regentech Limited, Central, The Hong Kong Special Administrative Region of the People's Republic of China

[21] Appl. No.: 08/901,311

[22] Filed: Jul. 28, 1997

[51] Int. Cl.[6] ..... F26B 3/34

[52] U.S. Cl. ..... 34/269; 34/603; 34/604

[58] Field of Search ..... 34/266, 267, 269, 34/602, 603, 604; 219/494, 510, 711

[56] References Cited

U.S. PATENT DOCUMENTS 4,041,614 8/1977 Robinet ..... 34/92
5,546,678 8/1996 Dhaemers ..... 34/275
5,724,750 3/1998 Buress ..... 34/603 X

*Primary Examiner*—Henry Bennett
*Assistant Examiner*—Steve Gravini
*Attorney, Agent, or Firm*—Ladas & Parry

[57] ABSTRACT

The present invention is categorized into the technical field of structural design of a clothes dryer, especially relating to the improvement of heating component in the clothes dryer. The present invention includes a stationary housing, a rotatable drum, and components of heating, ventilation transmission, and control installed within said housing. The heating system is formed by several special infrared lamps installed on the interior wall of said drum. The present invention optimizes the structure of a clothes dryer so that the clothes dryer has the advantages of lower power consumption, timesaving, adjustability of temperature, and lower temperature within said drum, etc.

19 Claims, 2 Drawing Sheets

INFRARED-RADIATING CLOTHES DRYER

FIELD OF THE INVENTION

The present invention is categorized into the technical field of structural design of a clothes dryer, especially relating to the improvement of heating component in the clothes dryer.

DESCRIPTION OF THE INVENTION

The conventional clothes dryer consists of a stationary housing, a rotatable drum, and components of heating, ventilation transmission, and control installed within said housing. The conventional heating component is a PTC semiconductor heating element (PTC) installed on the wall of said housing at the site of ventilation inlet. Once connected to the power supply, PTC increases its own temperature and then radiates heat into the surrounding air. The ventilation component will draw the heated air into the drum through ventilation inlet and the heated air will dry clothes within the drum. The mechanism of this kind of clothes dryers is to heat the clothes to a relatively higher degree, under which the rate of water vaporization out of the clothes is higher than that of moisture absorption into the clothes in said environment The disadvantages of the conventional clothes dryer include: 1) the consumed electric power is used not only to vaporize water from the clothes but also to heat up the clothes and large quantity of air, which results in higher electricity and power consumption and lower heating efficiency; 2) PTC is installed outside of the drum and the heated air needs to be transmitted into the drum through the ventilation inlet, as a result, the temperature outside of the drum is much higher than that inside of the drum and more power is consumed; 3) As this clothes drying method needs to heat up the clothes within the drum to a higher degree, it will prolong the time of clothes-drying and damage the clothes to some degree at the higher temperature; and 4) the heating temperature can not be adjusted based on the clothes materials.

The purpose of the present invention is to compensate the technical deficiency of current clothes dryers through using a new-type heating component. The present invention optimizes the structure of a clothes dryer so that the said clothes dryer has the advantages of lower power consumption, time-saving, adjustability of temperature, and lower temperature within said drum, etc.

The present invention features with an infrared-radiating clothes dryer, which comprises a stationary housing, a rotatable drum, and components of heating, ventilation, transmission, and control installed within said housing. The said heating system is formed by several infrared lamps and said lamps are installed on the interior wall of said drum. The said current inlet ring is connected with said drum-supporting shaft, while said electric brush installed on the outer wall of said drum is connected with said current inlet ring. If a perforated drum is used, said lamps can also be installed on the wall of said housing.

In order to improve the effect of water vaporization, said control component consists of a thyristor that is used for controlling the power of said lamps; and the wavelength of infrared radiation of said lamps ranges 1.2–6.5$\mu$; and said infrared lamps are made of the quartz tungsten halogen lamps sintered with a spacial infrared-radiating layer—a mixture of quartz powder and non-metal oxide, the oxygen enriched porous silica powder.

The clothes drying process of the present invention is described as follows: the clothes after washing and spinning are put into the drum. Upon the drying program is selected, the motor assembly is activated and the damp clothes are being tumbled along with the rotation of said drum. Once the infrared-radiating lamps are connected to the power, said lamps light up and radiate the infrared directly and evenly to the damp clothes. Under the direct infrared radiation, water molecules are vaporized out of the clothes and then the hot damp air within the drum are ventilated out by a fan. This makes the clothes dry.

The mechanism of present invention is to dry the clothes by using the method of radiating infrared to the clothes The best source of infrared radiation is to use quartz tungsten halogen lamps coated with oxygen enriched porous silicon. It is characterized by the fact that the radiating efficiency would increase when the infrared wavelength ranges 2–5$\mu$. The infrared radiation under this wavelength enables water molecules to be vaporized by unleashing the binding of surrounding water aggregates. Therefore, there is no need to heat the water to a higher degree so as to enhance the effect of water vaporizations The present invention has the following characteristics:

1. High efficiency: applying infrared radiation, especially with designated infrared wavelength, to clothes drying process brings not only the macro heating radiation effect, but also the effects of micro water molecules activation through the spectrum corresponding to thermal vibration and rotation of water molecules, and the effects of infrared heating and microwave drying. The efficiency of dehydration is much more enhanced as compared with the conventional method of drying clothes through heat.

2. Energy-saving: heating component installed within the drum enables the electricity consumption to be greatly reduced.

3. Clothes are dried under lower temperature, especially suitable for high-quality clothes made of low heat-resisting material.

4. The heating power can be adjusted through the thyristor that controls the electric circuit, so that different types of clothes can be dried under an optimal condition.

BRIEF DESCRIPTION OF ATTACHED FIGURES

Figure 1:
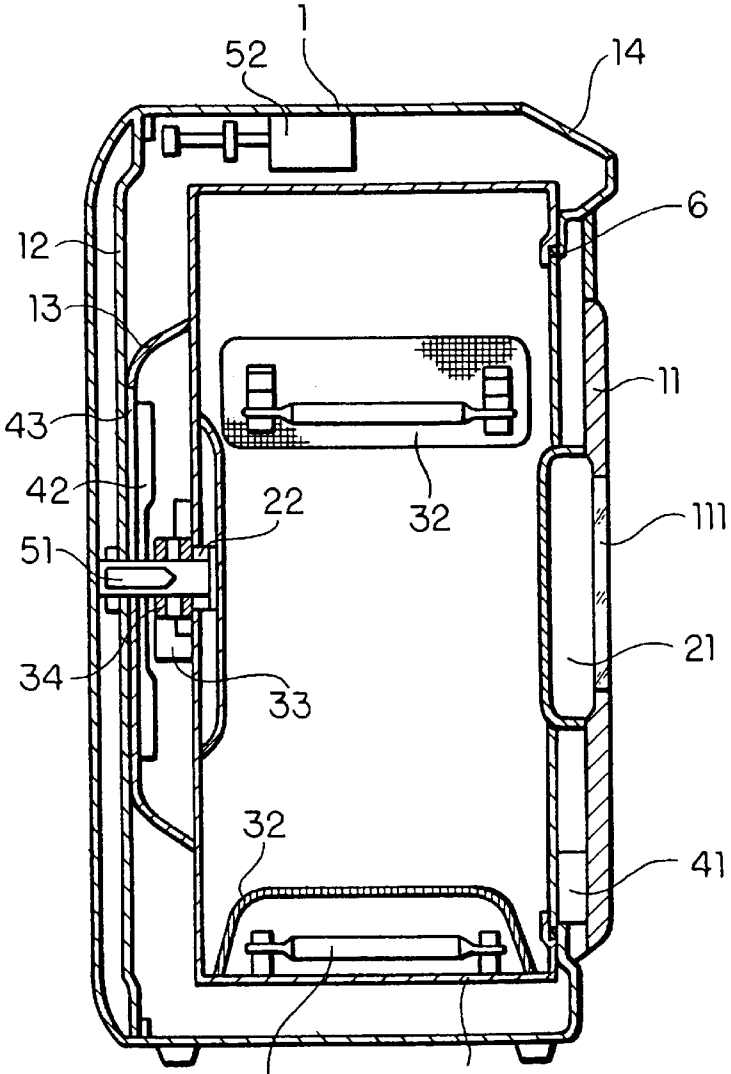
FIG. 1 illustrates the general structure of interior design of the present invention.
Figure 2:
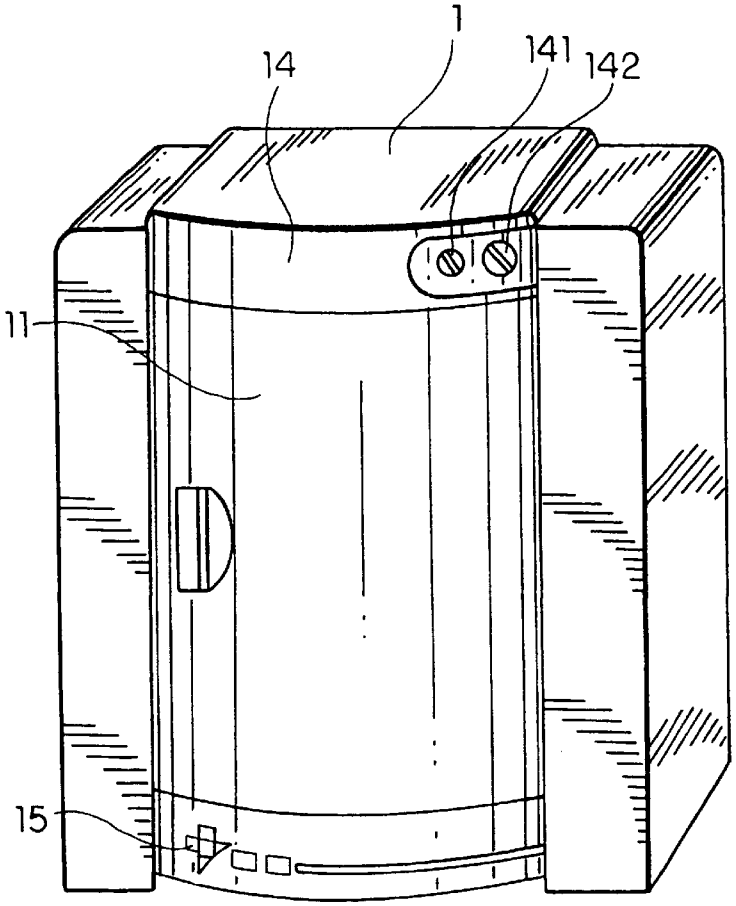
FIG. 2 illustrates the exterior design of the present invention
Figure 3:
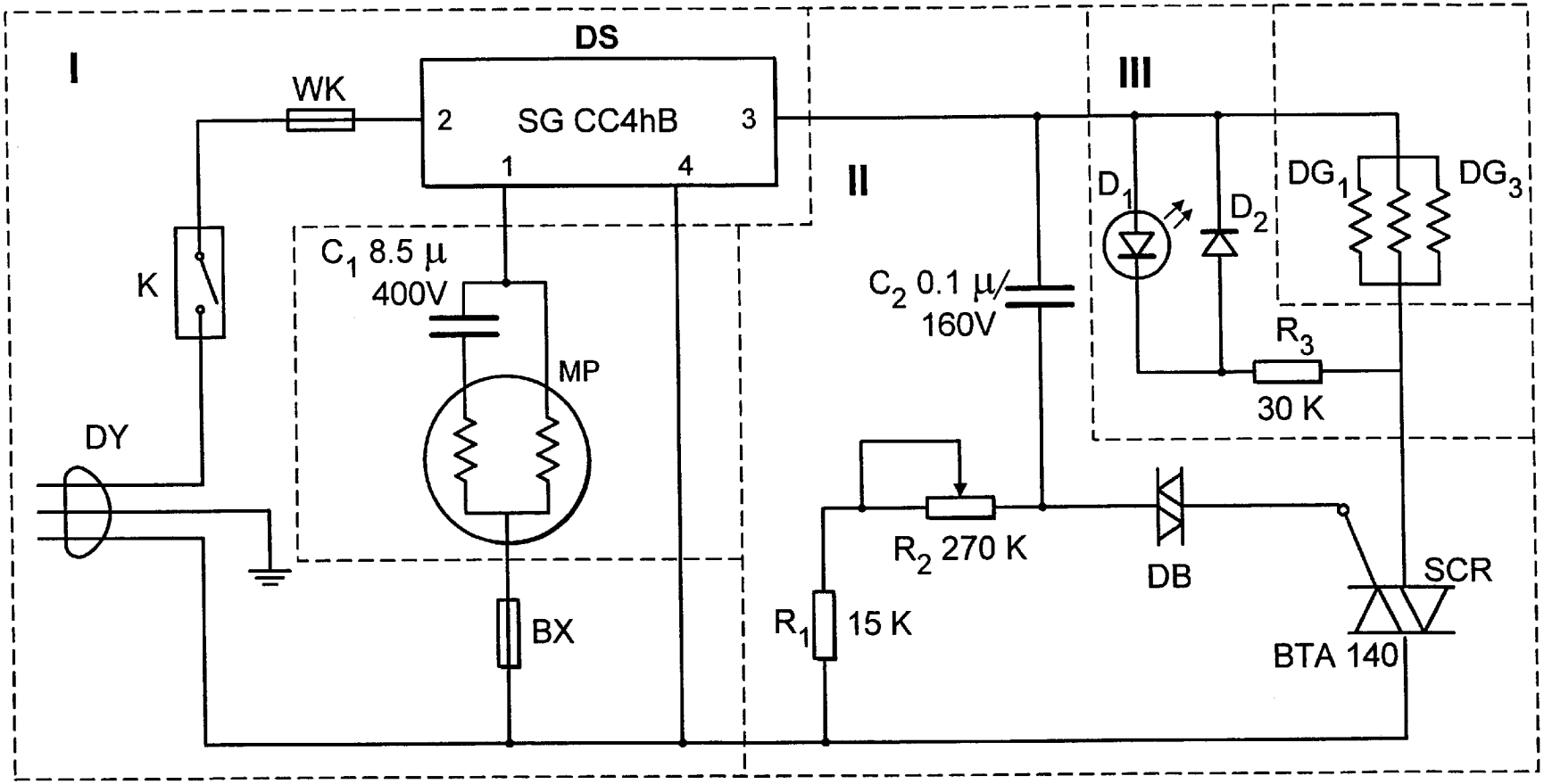
FIG. 3 illustrates the mechanism of the main electric circuit

The present invention features with a new type of infrared-radiating clothes dryers. As illustrated in FIGS. 1–3 and annex, detailed description is presented as follows.

The present invention consists of a stationary housing, a rotatable drum, and components of heating, ventilation, transmission, and control, the structures of which are illustrated in FIG. 1. The function and structure of each component are described as follows.

The drum (2) is put horizontally in the central location of the housing (1). The front of the housing has a round opening (21) corresponding to a monitoring window (111) on the housing door (11). The housing has a supplementary supporting function and a felt seal (6) is installed in between in order to reduce the air entrance through crevice. At the back of the drum a shaft sleeve (22) is connected to a supporting shaft (51). The supporting shaft (51) is fixed on the stand (12) at the back of the housing. A motor (52) rotates the drum (2) along the supporting shaft through the pulley installed on the outer wall of the drum.

The lower front of the housing has a ventilation inlet (41). A fan (42) is installed on the supporting shaft (51) and the protection cap (13) driven by the motor (52) is used to cover the fan (42). On the protection cap, there is a ventilation outlet (43). When the fan turns, fresh air will be drawn in through the ventilation inlet (41), be circulated in the drum (2) and then the damp air caused by water vaporization will be exhausted out through the ventilation outlet (43).

A group of lamps (three to six lamps) (31) is evenly installed on the interior side wall of the drum (2). The lamps are heat-insulated by ceramic stand on the lamp bracket. Outside of the lamps, there is a netted lampshade (32) in arch shape to cover the lamps. The special infrared source used in the present invention has a wavelength of 3–4$\mu$. The surface temperature of the lamps is set at 300° C. The selected lamp is quartz lamp. In accordance with the method of making tungsten halogen lamps, a mixed layer of quartz, powder and non-metal oxide, the oxygen enriched porous silica powder is sintered on (he lamp. In order to make sintering work easier, 25% of quartz powder needs to be added to the mixture. The useful life of the lamp is approximately 1,000 hours. The lighting lamp does not break when splashed with water. The coated layer is of non-poison evidenced by a lab test.

The power wire is connected to the electric brush (33) through the wall of the drum, while the electric brush is connected with current inlet ring. The wire of current inlet ring is placed through the supporting shaft (51), which is controlled by the main electric circuit for switch control and power level.

The main electric circuit of the dryer consists of timer electric circuit 1, power control electric circuit 11, and indicating electric circuit. As shown in FIG. 3, each electric circuit graph is separated by dotted line.

The timer electric circuit is used for setting clothes drying time and consists of a timer DS (model SG CC4hB) that controls switch of motor and lamps, a temperature controller, and a moisture controller (WK). When temperature increases to the alarming threshold, automatic switch-off will avoid clothes damage. The present invention has a fussing wire (BX) installed and there is a switch (K) on the door of the dryer. When the door is open or not closed tightly, the main electric circuit can not be activated so as to avoid any potential danger.

The power control electric circuit consists of dura-directional thyristor SCR (Model BTA 140), trigger diode, R1, R2, and C2. The electric potentiometer R2 is controlled through adjusting the power on the controlling panel. The power output of three groups of infrared-radiating lamps (DG1, DG2, DG3) can also be adjusted through the change of conduction angle of the thyristor.

Indicating electric circuit consists of D1, D2, R3 and can monitor the working condition and power level of said lamps.

The working mechanism of the electric circuits is explained as follows: The power supply of the motor (MD) is controlled by the timer (DS) as well as the door switch (K). The power level of three lamps (DG1, DG2, DG3) are simultaneously controlled by the thyristor. The charging electric circuit is formed by R1, R2, C2 and changing the resistance of R2 can change the charging time. When the electric potential (if C2 reaches certain level, the trigger diode and the dura-directional thyristor is connected in succession, then the power is provided. Through adjustment of R2, the conduction angle of the thyristor can be controlled so that the power level of lamps can be adjusted. The indicating electric circuit is formed D2 protects luminous diode from breakdown. There is also a temperature controller on the electric circuit, which is used for switching if the electric circuit when the temperature exceeds certain level. The fuse-wire is installed to avoid large current volume getting through the electric circuit.

The controlling panel is installed on the top of the housing. The clothes drying time, the highest allowable temperature, and the clothes drying method can be selected based on the clothes material and number of clothes, the power of the clothes dryer can be adjusted through conduction angle of the thyristor. The operation can be performed automatically or manually. The sensors of temperature and moisture shall be placed on the lampshade and ventilation outlet. Based on the sensors' feedback, the power of the lamps is adjusted.

As shown in FIG. 2, the housing door (11) is located in the front center of the housing (1). There is a monitoring widow (111) on the housing door and the monitoring widow is made of dark plexiglass. There is a controlling panel (14) on the upper front of the housing. On the controlling panel there is a power control knob (141) and a timer knob (142). The lower front of the housing has a decorative cover (15) on which the trade mark and decorative graph can be printed. The controlling panel and the decorative cover are exchangeable. When the dryer is placed on the ground, the controlling panel shall be put on the top of the dryer to avoid ground water damage to the panel. When the dryer is placed on a clothes washer or somewhere above the ground, the controlling panel can be installed at the bottom of the dryer for handy operation.

I claim:

1. An infrared-radiating clothes dryer comprising:

a stationary housing, a rotatable drum installed within said housing, and heating, ventilation, transmission, and control systems within said housing capable of cooperating to operate said dryer characterized in that said heating system comprises a plurality of infrared lamps each operable to emit infrared radiation with a wavelength ranging 1.2–6.5 micrometers.

2. The clothes dryer according to claim 1, characterized in that said infrared lamps are installed on an interior wall of said drum.

3. The clothes dryer according to claim 2, characterized in that a power supply for said infrared lamps conducts through a current inlet ring, an electric brush, a drum-supporting shaft of said dryer, said current inlet ring being connected with said drum-supporting shaft, said electric brush being installed on an outer wall of said drum and connected to said current inlet ring.

4. The clothes dryer according to claim 1, characterized in that said infrared lamps are installed on an interior wall of said housing.

5. The clothes dryer according to claim 1, characterized in that said control system comprises a thyristor used for controlling power for said lamps.

6. The clothes dryer according to claim 1, characterized in that said infrared lamps are operable to emit infrared radiation with a wavelength in a range of 3–4 micrometers.

7. The clothes dryer according to claim 6, characterized in that said infrared lamps are made of quartz tungsten halogen lamps sintered with an infrared-radiating layer, mixture of quartz powder and non-metal oxide, and oxygen enriched porous silica powder.

8. The clothes dryer according to claim 7, characterized in that said oxygen enriched porous silica powder is mixed with 25 percent quartz powder.

9. An infrared-radiating clothes dryer including a stationary housing, a rotatable drum installed within said housing, a heating system, a ventilation system, a transmission, and a control system coordinating inter-operability of said systems, the improvement comprising:

a plurality of infrared lamps in said heating system and operable to emit infrared radiation with a wavelength corresponding to thermal vibration and rotation of water molecules whereby heating clothes in the dryer such that a rate of water vaporization out of said clothes is higher than moisture absorption into the clothes in said dryer.

10. The clothes dryer according to claim 9, wherein said infrared lamps are installed on an interior wall of said housing.

11. The clothes dryer according to claim 9, wherein said infrared lamps are operable to emit infrared radiation with a wavelength in the range of 3–4 micrometers.

12. A clothes dryer comprising:

a stationary housing;

a rotatable drum within said housing;

a heating system within said housing, said heating system comprising a plurality of infrared radiation lamps operable to emit radiation with a wavelength of 1.2–6.5 micrometers;

a transmission within said housing and coupled to said rotatable drum, a ventilation system communicating an interior of said housing with an exterior environment; and a control system coupled to each of said heating system, ventilation system and control system, said control system being operable to coordinate operation of said ventilation system, heating system and transmission, said wavelength corresponding to thermal vibration and rotation of water molecules whereby heating clothes in the dryer to produce a rate of water vaporization out of said clothes that is higher than moisture absorption into the clothes in said dryer.

13. The clothes dryer according to claim 12, wherein said infrared lamps are installed on an interior wall of said drum.

14. The clothes dryer according to claim 13, wherein said control system comprises a power supply for said infrared lamps, said power supply operable to transmit current through an inlet ring, an electric brush, a drum-supporting shaft of said dryer, said current inlet ring being connected with said drum-supporting shaft, said electric brush being installed on an outer wall of said drum and connected to said current inlet ring.

15. The clothes dryer according to claim 12, wherein said infrared lamps are installed on an interior wall of said housing.

16. The clothes dryer according to claim 12, wherein said control system comprises a thyristor operable to control power to said lamps.

17. The clothes dryer according to claim 12, wherein said lamps are operable to emit infrared radiation with a wavelength of 3–4 micrometers.

18. The clothes dryer according to claim 12, wherein said lamps are quartz tungsten halogen lamps sintered with an infrared radiating powder layer, a mixture of quartz powder and non-metal oxide, and oxygen enriched porous silica powder.

19. The clothes dryer according to claim 18, wherein said oxygen enriched porous silica powder is mixed with 25 percent of quartz powder.

* * * * *